US008561757B1

(12) United States Patent
Edsall

(10) Patent No.: US 8,561,757 B1
(45) Date of Patent: Oct. 22, 2013

(54) FIREARM SUPPRESSOR

(76) Inventor: Richard A. Edsall, Ashton, MD (US)

( * ) Notice: Subject to any disclaimer, the term of this patent is extended or adjusted under 35 U.S.C. 154(b) by 44 days.

(21) Appl. No.: 13/304,917

(22) Filed: Nov. 28, 2011

(51) Int. Cl.
*F41A 21/00* (2006.01)

(52) U.S. Cl.
USPC ..... 181/223; 89/14.4

(58) Field of Classification Search
USPC ..... 181/223; 89/14.4
See application file for complete search history.

(56) References Cited

U.S. PATENT DOCUMENTS

| | | | | | |
|---|---|---|---|---|---|
| 1,111,202 | A * | 9/1914 | Westfall | 89/14.4 |
| 1,127,250 | A * | 2/1915 | Humm | 181/223 |
| 1,773,443 | A * | 8/1930 | Wilman | 89/14.4 |
| 2,442,773 | A * | 6/1948 | Mason | 181/223 |
| 2,448,382 | A * | 8/1948 | Mason | 89/14.4 |
| 3,385,164 | A | 5/1968 | Etal | |
| 3,713,362 | A * | 1/1973 | Charron | 89/14.4 |
| 4,176,487 | A * | 12/1979 | Manis | 42/76.01 |
| 4,530,417 | A * | 7/1985 | Daniel | 181/223 |
| 4,588,043 | A | 5/1986 | Finn | |
| 4,785,909 | A * | 11/1988 | Young | 181/252 |
| 5,029,512 | A | 7/1991 | Latka | |
| 5,164,535 | A | 11/1992 | Leasure | |
| 5,679,916 | A | 10/1997 | Weicher | |
| 6,109,387 | A * | 8/2000 | Boretti | 181/230 |
| 6,308,609 | B1 | 10/2001 | Davies | |
| 6,796,214 | B2 * | 9/2004 | Hausken et al. | 89/14.4 |
| 2004/0079221 | A1 * | 4/2004 | Woods et al. | 89/14.4 |

* cited by examiner

*Primary Examiner* — David Warren
*Assistant Examiner* — Christina Russell
(74) *Attorney, Agent, or Firm* — Lieberman & Brandsdorfer, LLC

(57) ABSTRACT

Embodiments of the invention relate to a dynamic suppression mechanism for a firearm. Multiple dynamic volume chambers are aligned within a housing. An aperture is provided within the aligned chambers to accommodate the projectile. As the projectile travels through the aperture across the length of the housing, each of the chambers is subject to a dynamic expansion and contraction, with the dynamic volume change absorbing byproduct of the traveling projectile.

23 Claims, 2 Drawing Sheets

FIREARM SUPPRESSOR

FIELD OF THE INVENTION

The present invention relates to a firearm apparatus and a method for suppressing noise associated with movement of a projectile. More specifically, the present invention mitigates noise associated with the projectile as it travels through a tubular housing of the firearm during discharge.

BACKGROUND

Firearms function by discharging a projectile through an associated firearm housing. During use, a projectile travels through the housing at an accelerated speed and then discharges to a target or target vicinity. One byproduct of the projectile traveling through the housing is noise. It is known in the art to employ a suppressor, also known as a silencer, to reduce the noise associated with the projectile discharge. Various configurations have been employed to reduce noise.

SUMMARY OF THE INVENTION

The present invention relates to an apparatus and method for mitigating noise associated with discharge of a projectile from a firearm.

In one aspect of the invention, an apparatus is provided with a tubular housing secured to a muzzle end of a firearm. The tubular housing defines a hollow interior that surrounds a path along which a projectile can travel when subject to discharge. More specifically, the tubular housing has two ends defined as a first end and a second end. The first end is secured to the muzzle end of the firearm, and the second end is oppositely disposed. Within the tubular housing there are multiple dynamic volume chambers that extend from the first end to the second end. Each of the dynamic volume chambers includes an axially variable material that is configured to dynamically extend between a compressed state and a non-compressed state. In addition, a separator is provided between ends of the multiple chambers. Both the separator and the hydraulic absorbing material include apertures, with the apertures being aligned to enable the projectile to travel there through.

In another aspect, an apparatus is provided with a tubular housing configured to secure to a muzzle end of a firearm. The tubular housing defines a hollow interior that surrounds a path along which a projectile can travel. More specifically, the tubular housing has a first end and a second end. The first end of the housing is secured to the muzzle end of the firearm, and the second end of the housing is oppositely disposed. The tubular housing includes multiple dynamic volume chambers therein, with the chambers disposed between the first and second ends. Each set of adjacently arranged chambers includes, axially variable material having a sequential arrangement. A first material is in a first chamber and a second material is in a second chamber. An initial state of equilibrium of the materials is when the springs are compressed. A separator is provided between the first and second chambers, and at the same time is in communication with the materials. Both the separator and the materials are configured with an aperture. An alignment of the apertures is provided to accommodate travel of the projectile.

Other features and advantages of this invention will become apparent from the following detailed description of the presently preferred embodiments of the invention taken in conjunction with the accompanying drawings.

Figure 1:
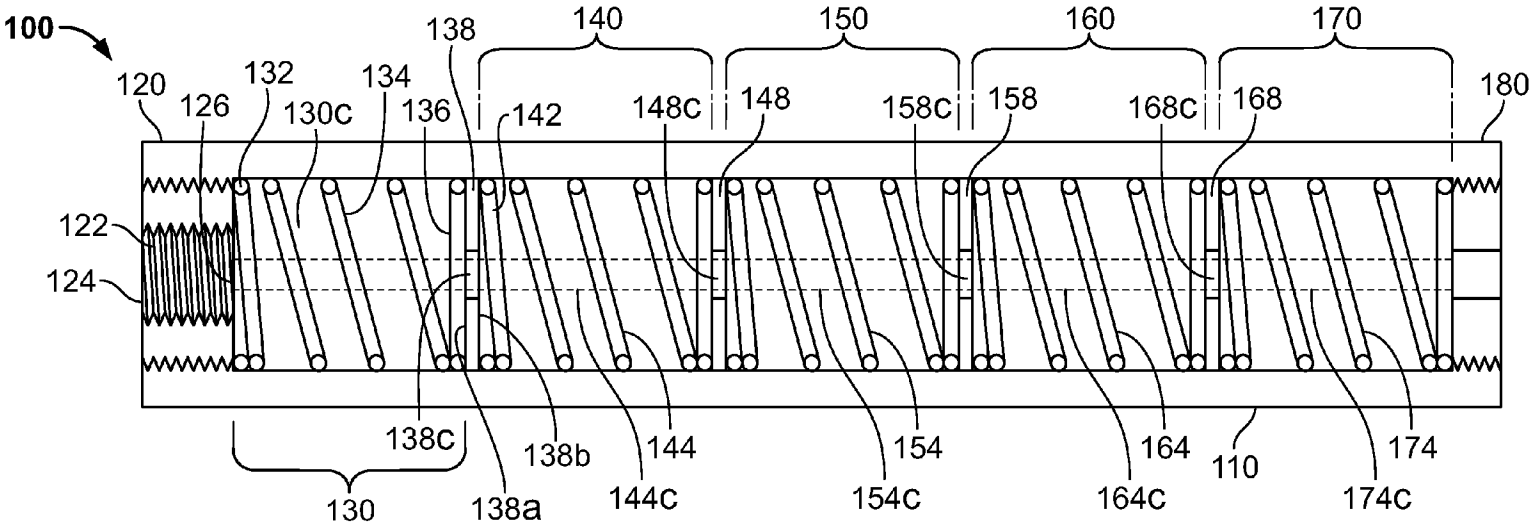
FIG. 1 is a sectional view of one embodiment of a noise suppressor for a firearm.

The drawings referenced herein form a part of the specification. Features shown in the drawings are meant as illustrative of only some embodiments of the invention, and not of all embodiments of the invention unless otherwise explicitly indicated. Implications to the contrary are otherwise not to be made.

DETAILED DESCRIPTION

As noted, suppression of noise from a firearm is not a new concept. Prior art configurations of noise suppressors employ fixed baffles which is a static approach to resolving the aspect of noise suppression. Accordingly, there is a need for a dynamic solution that functions to reduce energy of gases propelled from a projectile exiting an associated firearm muzzle.

It will be readily understood that the components of the present invention, as generally described and illustrated in the Figures herein, may be arranged and designed in a wide variety of different configurations. Thus, the following more detailed description of the embodiments of the apparatus, system, and method of the present invention, as presented in the Figures, is not intended to limit the scope of the invention, as claimed, but is merely representative of selected embodiments of the invention.

Reference throughout this specification to "a select embodiment," "one embodiment," or "an embodiment" means that a particular feature, structure, or characteristic described in connection with the embodiment is included in at least one embodiment of the present invention. Thus, appearances of the phrases "a select embodiment," "in one embodiment," or "in an embodiment" in various places throughout this specification are not necessarily all referring to the same embodiment.

Furthermore, the described features, structures, or characteristics may be combined in any suitable manner in one or more embodiments. In the following description, numerous specific details are provided, such as examples of noise supporting elements for a firearm and an associated projectile associated therewith to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

The illustrated embodiments of the invention will be best understood by reference to the drawings, wherein like parts are designated by like numerals throughout. The following description is intended only by way of example, and simply illustrates certain selected embodiments of devices, systems, and processes that are consistent with the invention as claimed herein.

A noise suppressor for a firearm utilizing concepts of the invention is illustrated in FIG. 1. More specifically, FIG. 1 is a sectional view of one embodiment of the noise suppressor (100). The suppressor includes an annular shaped body (110) having a first end (120) and a second end (180). The first end (120) includes a threaded interior wall (122) configured to be secured to threads of a barrel of a firearm (not shown). In one embodiment, the first end (120) may be alternatively configured and secured to the barrel of the firearm. The threaded interior wall (122) is one embodiment that may be employed for the securement. As shown, the threaded wall (122) has an annular aperture (124) that extends from the first end (120) to an interior second end (126). The size of the aperture is configured with a diameter that is greater than the diameter of a projectile exiting from the barrel of the firearm. Accordingly, the threaded interior wall is configured to secure to the barrel of the firearm and sized to receive a projectile exiting the barrel.

The threaded interior wall (122) is shown adjacent to the first end (120) of the annular shaped body (120). The second interior end (126) of the threaded wall is adjacently position to a first dynamic volume chamber (130). In the example shown herein, there are five dynamic volume chambers (130), (140), (150), (160), and (170). The first dynamic volume chamber (130) is adjacently mounted to the threaded wall (122), and the fifth dynamic volume chamber (170) is mounted adjacent to the second end (180). Although five dynamic volume chambers are shown, the invention should not be limited to this quantity. In one embodiment, the suppressor may be limited to two or more dynamic volume chambers. Accordingly, multiple dynamic volume chambers are provided within the body of the suppressor.

Each dynamic volume chambers is identical to an adjacently mounted dynamic volume chamber, and will be described herein with specificity with respect to the first dynamic volume chamber (130). As shown, the dynamic volume chamber (130) includes a hydraulic absorbing material (134) that extends the length of the chamber. In one embodiment, the absorbing material is any material configured to absorb shock and sound, i.e. compression and rarefaction of ambient gas. More specifically, each chamber (130) has a first end (132) and a second end (136). With respect to the first chamber (130), the first end (132) is adjacent to and in communication with the threaded wall (122) and the second end (136) defines the distal boundary of the chamber (132). A separator (138) is provided adjacent to the distal boundary of the first chamber (130). The separator (138) is in communication with the first end (132) of a first absorbing material (134) on a first side (138*a*) of the separator (138) and is in communication with a first end (142) of a second absorbing material (144) on a second side (138*b*) of the separator (138).

Each absorbing material and each adjacently mounted separator is configured and aligned with an aperture sized to receive a projectile. More specifically, the first absorbing material (134) of the first chamber (130) is configured with aperture (130*c*), and separator (138) is configured with aperture (138*c*). Both of these apertures (130*c*) and (138*c*) are at or near the same diameter and are aligned together and with the aperture of the threaded wall (122). Each of the sequential chambers (140)-(170) are configured with separate absorbing materials (144), (154), (164), and (174) respectively, with each absorbing material configured with an aperture (144*c*), (154*c*), (164*c*), and (174*c*), respectively. Accordingly, a projectile discharged from the firearm may travel an axial path formed by the aligned apertures through the body (110).

As shown in the example herein, there are five dynamic volume chambers, with the fifth chamber (170) being the furthest disposed from the firearm. The fifth chamber (170) includes an adjacently mounted exit (180). Upon completion of travel of the projectile through the fifth chamber, the projectile will exit the body (110) through the exit (180).

Each of the dynamic volume chambers (130)-(170) illustrated in FIG. 1 are shown in a rest state wherein the absorbing material is compressed. In one embodiment, the absorbing material may be in the form of a spring or an elastomer, or any material that is axially variable, i.e. changes shape along an axis, with the rest state including the absorbing material in a compressed state. As the projectile enters the first chamber (130), the absorbing material de-compresses and expands thereby causing movement of the first separator (138) in a lateral direction. In one embodiment, the body (110) is comprised of a non-expanding material; as such the expansion limits of each absorbing material are limited to the lateral direction. The projectile travels through the body one chamber at a time. As the projectile exits the first chamber (130), the absorbing material returns to a rest state, i.e. compressed form, and moves in the process, while the second chamber (140) receives the projectile with the second spring (132) de-compressing as the projectile travels through the second chamber. Each separator (138), (148), (158), is configured with aperture (138*c*), (148*c*), (158*c*), and (168*c*), respectively. In addition, each separator (138), (148), (158), and (168) is sized so that an exterior edge is in communication with an interior wall of the body (110). As such, as each separator (138)-(178) is subject to axial movement associated with compression and de-compression of the absorbing material, debris that is in communication with the interior wall of the body (110) is removed from the wall.

As the projectile travels through the body (110) and each chamber therein (130)-(170), the projectile emits a byproduct. In one embodiment, the byproduct is a gas emitted by the projectile. Similarly, in another embodiment, the byproduct may include percussive energy, sound energy, and/or shock from the projectile. In both forms, the byproduct causes an expansion of the hydraulic absorbing material that extends the length of the associated chamber. Once the projectile exits the chamber, the material returns to an equilibrium state, i.e. compressed. Accordingly, the byproduct of the projectile causes the hydraulic absorbing material to change from a compressed state to an expanded state, and then to return to the compressed state upon discharge of the projectile.

Figure 2:
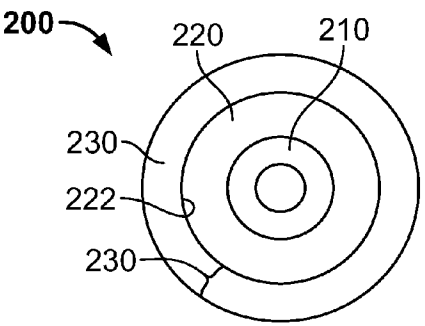
FIG. 2 is a front view of the suppressor shown in FIG. 1.

FIG. 2 is a front view (200) of the suppressor shown in FIG. 1. As shown, there are three concentric sections (210), (220), and (230). Starting from an interior portion of the suppressor, the first concentric section (210) represents the path of the projectile through the length of the suppressor. The path is formed by a combination of the chambers. More specifically, as shown in FIG. 1, each chamber is comprised of a separator and an absorbing material, with an aperture formed in both the separator and the absorbing material. Each separator is aligned with adjacently positioned absorbing material so that the apertures are aligned. Specifically, the separator of a chamber is aligned with the absorbing material in the chamber, as well as aligned with the absorbing material in an adjacently positioned chamber. This alignment and positioning of the separator with the absorbing material formed the path of the projectile as represented by the first concentric section (210).

As shown in FIG. 2, in addition to the first section (210), there are second and third sections (220) and (230), respectively. The second section (220) represents a width of an interior compartment of the suppressor. Each chamber and each separator have a width that extends the size of the width of the interior compartment. As described above in FIG. 1, as the chambers expand and contract, the separators are subject to movement with the adjacently positioned material. During this movement, the outside edge of each of the separators is in contact with an interior wall, as represented at (222), and this contact and movement effectively enables the separator to clean the residue created by the projectile and/or absorbing material from the interior wall (222). Accordingly, the second section (222) represents the width of the interior compartment of the suppressor.

The third concentric section (230) represents the exterior wall of the suppressor and its associated width. More specifically, the suppressor has an exterior wall that has a width that extends to the outermost side of the second section (220). The suppressor has a defined width to support housing the components or each compartment as well as functioning to mitigate noise by-product associated with travel of the projectile from the firearm and through the length of the suppressor.

In the embodiments shown in FIGS. 1 and 2, the suppressor is shown with five chambers, and each of the chambers including hydraulic absorbing material. The suppressor may include a minimum of one chamber, or expanded to include two or more additional chambers. The absorbing material may include a variety of material. In one embodiment, the absorbing material is in the form of a spring with each spring to extend the length of the chamber in which it is housed. In one embodiment, the material of the spring enables the spring or any material that absorbs compression and rarefaction of gas may withstand a temperature up to 550 degrees Fahrenheit. The separators, one per chamber, may be in the form of a washer, machined annular sleeve, ring of metal, etc., with each separator having an aperture sized to receive the projectile and a width sized to the width of the chamber so that the separator may remove debris that forms along the interior wall of the suppressor.

Figure 3:
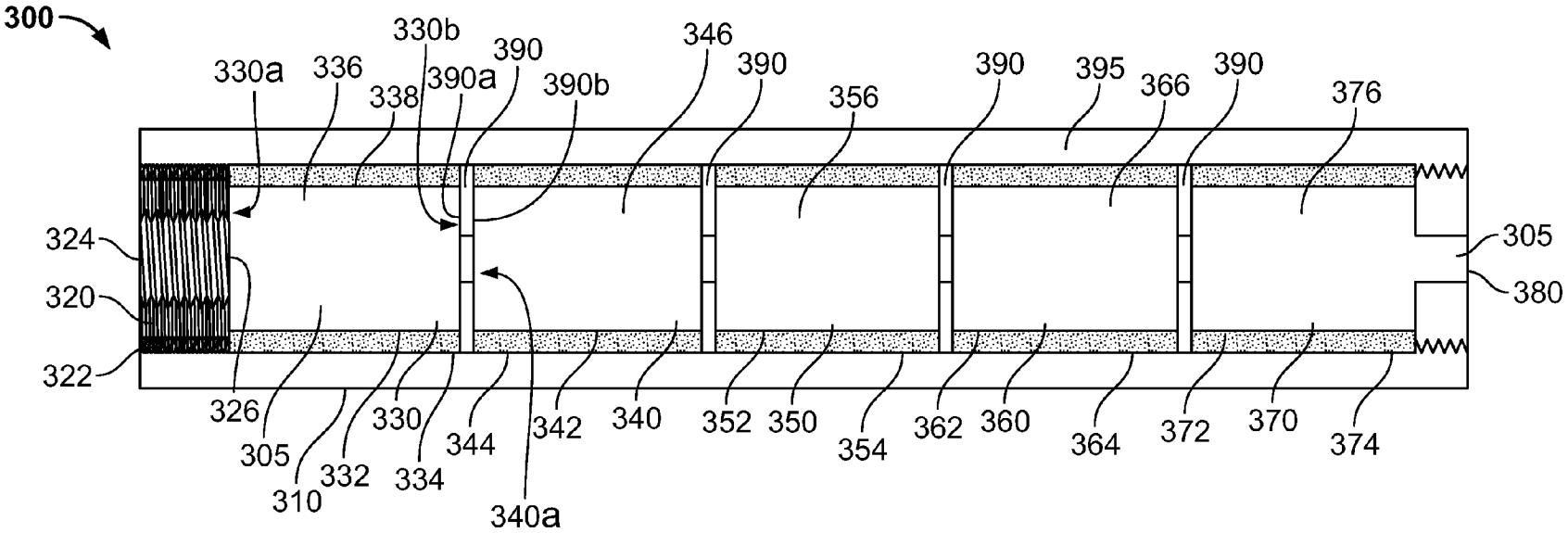
FIG. 3 is a sectional view of another embodiment of a noise suppressor for a firearm.

FIG. 3 is a sectional view of another embodiment of a noise suppressor (300) for a firearm. The suppressor includes an annular shaped body (310) having a first end (320) and a second end (380). An annular shaped aperture (305) is formed through the body (310) to accommodate noise suppression materials. In one embodiment, the body (310) is comprised of an aluminum material. The first end (320) includes a threaded interior wall (322) configured to be secured to threads of a barrel of a firearm (not shown). In one embodiment, the first end (320) may be alternatively configured and secured to the barrel of the firearm. The threaded interior wall (322) is one embodiment that may be employed for the securement. As shown, the threaded wall (322) has an annular aperture (324) that extends from the first end (320) to an interior second end (326). The size of the aperture is configured with a diameter that is greater than the diameter of a projectile exiting from the barrel of the firearm. Accordingly, the threaded interior wall is configured to secure to the barrel of the firearm and sized to receive a projectile exiting the barrel.

The threaded interior wall (322) is shown adjacent to the first end (320) of the annular shaped body (320). The second interior end (326) of the threaded wall is adjacently position to a first chamber (330) of a series of chambers. In the example shown herein, there are five chambers (330), (340), (350), (360), and (370). The first chamber (330) is adjacently mounted to the threaded wall (322), and the fifth chamber (370) is mounted adjacent to the second end (380). Although five chambers are shown, the invention should not be limited to this quantity. In one embodiment, the suppressor may be limited to two or more chambers. Each chamber has a sleeve, with each sleeve having an interior wall (332), (342), (352), (362) and (372) and an exterior wall (334), (344), (354), (364), and (374). Each of the interior walls is adjacent to an interior area of the chamber (336), (346), (356), (366), and (376); each of the exterior walls of the respective sleeves (334)-(374) are adjacently positioned to the annular shaped aperture (305) of the body (310). Accordingly, multiple chambers are positioned within the body of the suppressor.

Each chamber is identical to an adjacently mounted chamber, and will be described herein with specificity with respect to the first chamber (330). As shown, the chamber (330) includes an exterior wall sleeve (332) comprised of a material (338) to absorb compression and rarefaction of ambient gas, hereinafter referred to as an absorbing material, that extends the length of the chamber. In one embodiment, the absorbing material of the exterior wall may be in the form of a polyurethane, neoprene or silicon material. Each chamber (330) has a first end (330*a*) and a second end (330*b*). With respect to the first chamber (330), the first end (330*a*) is adjacent to and in communication with the threaded wall (322) and the second end (330*b*) defines the distal boundary of the chamber (332). A separator (390) is provided adjacent to the distal boundary of the first chamber (330). In one embodiment, the separator (390) is comprised of a stainless steel or aluminum material. The separator (390) is in communication with the second end (330*b*) of the first chamber (330) on a first side (390*a*) of the separator (390) and is in communication with a first end (340*a*) of the second chamber (340) on a second side (390*b*) of the separator (390). As shown, a separate (390) is provided between each set of adjacently position chambers.

Alignment of the multiple chambers (330)-(380), each comprised of a fluid responsive material encased within the annular shaped body (310), effectively forms a tube (395). The material may be in the form of polyurethane, neoprene, silicone rubber, or other fluid responsive material. In one embodiment, the material may withstand a temperature up to 500 degrees Fahrenheit. Each adjacently mounted chamber is separated by a separator. The configuration of the tube (395), including the material composition, provides flash suppression for a projectile traveling through the tube (395). The separators are each comprised of stainless steel, or an alternative material, that is resistive of high temperatures and flash associated with travel of the projectile. Each of the chambers (330)-(380), and more specifically, the respective separators, are adjacently mounted and aligned with an aperture sized to receive the projectile. Accordingly, a projectile discharged from the firearm may travel an axial path formed by the aligned apertures through the body (310).

As shown in the example herein, there are five chambers, with the fifth chamber (370) being the furthest disposed from the firearm. The fifth chamber (370) includes an adjacently mounted exit (380). Upon completion of travel of the projectile through the fifth chamber, the projectile will exit the body (310) through the exit (380). As the projectile travels through the chambers, the projectile emits a byproduct, such as gas, percussive energy, sound energy, flash, etc. The byproduct causes an expansion of the hydraulic absorbing material of the chamber walls, e.g. polyurethane, neoprene, or silicone rubber polymer. Once the projectile exits the chamber, the hydraulic absorbing material returns to an equilibrium state, i.e. compressed. Accordingly, the byproduct of the projectile causes the hydraulic absorbing material to change from a compressed state to an expanded state, and then to return to the compressed state upon discharge of the projectile.

Each separator (390) is subject to axial movement along the length of its respective chamber. In one embodiment, the absorbing material that lines the chamber is in a compressed state at equilibrium and de-compresses when the projectile travels through the chamber. The axial movement of the separator (390) is associated with compression and de-compression of the absorbing material. Debris does not accumulate on the interior walls of the chamber. In one embodiment, the characteristics of the material do not enable debris to adhere to the surface. The debris associated with any projectile byproduct exits the chamber through the same aperture as the projectile. As such, there is no need for a cleaning of the interior walls of the chamber(s).

Figure 4:
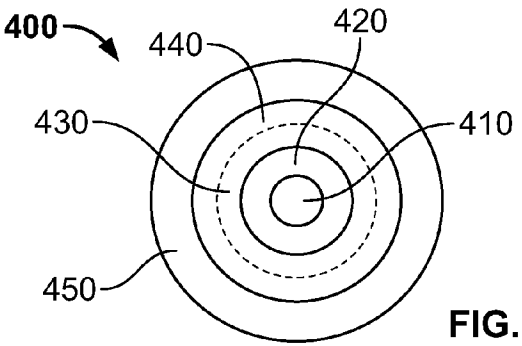
FIG. 4 is an end view of the noise suppressor shown in FIG. 3.

FIG. 4 is an end view (400) of the noise suppressor shown in FIG. 3. As shown, there are five concentric sections (410), (420), (430), (440), and (450). Starting from an interior portion of the suppressor, the first concentric section (410) represents the path of the projectile through the openings in each of the separators. The path is formed by a combination of the chambers and their associated separators. Each adjacent chamber is aligned by the annular shaped aperture (305) such that the separators and their associated apertures are aligned. The second concentric section (420) represents the diameter of the threaded opening that secures the suppressor body to the firearm. The third concentric section (430) represents an interior wall of each of the chambers, with the fourth concentric section (440) representing an end view of the silicon elastomer section. The fifth concentric section (450) represents an exterior wall of the suppressor body (310). Accordingly, as shown herein, each of the components of the suppressor have an annular representation and are aligned to form a path for travel of a projectile exiting the firearm, with the materials of the components functioning to suppress both noise and flash associated with the projectile travel.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope. Accordingly, the scope of protection of this invention is limited only by the claims and their equivalents.

I claim:

1. An apparatus comprising:

a tubular housing in communication with a muzzle end of a firearm, the tubular housing defining a hollow interior surrounding a path along which a projectile can travel;

the tubular housing having a first end and a second end, the first end secured to the muzzle end of the firearm, and the second end oppositely disposed, the tubular housing comprising:

a plurality of dynamic volume chambers disposed between the first end and the second end, each dynamic volume chamber comprising:

an axially variable material that dynamically extends from an initial compressed state prior to receipt of the projectile; and a separator in communication with the material, the separator having aligned apertures through which the projectile travels.

2. The apparatus of claim 1, further comprising the tubular housing having a threaded end in communication with the muzzle of the gun.

3. The apparatus of claim 1, further comprising the material to extend between the initial compressed state and a non-compressed state.

4. The apparatus of claim 3, wherein the material is selected from the group consisting of: a spring, polyurethane, neoprene, silicon rubber, and any axially variable material.

5. The apparatus of claim 3, further comprising the material to absorb shock between adjacent chambers, wherein the shock is reflected in the expansion of the material in each individual chamber.

6. The apparatus of claim 1, further comprising the material to change axially as the projectile travels through the aperture of the material, the change of the material to consume an element selected from the group consisting of: gas emitted from the projectile, percussive energy from the projectile, and combinations thereof, the element being a byproduct from the projectile as it travels through the chamber.

7. The apparatus of claim 6, further comprising the material to return to the initial state following release of the projectile from the tubular housing.

8. The apparatus of claim 6, wherein the expansion of the material is dynamic and a reflection of projectile travel.

9. The apparatus of claim 1, further comprising the separator to move in an axial direction with axial movement of material associated with compression and decompression.

10. The apparatus of claim 9, further comprising the axial movement of the separator to remove debris from an interior wall of the tubular housing.

11. The apparatus of claim 9, further comprising the axial movement of the separator to absorb sound energy transmitted from gases emitted with travel of the projectile.

12. An apparatus comprising:

a tubular housing adapted to be secured to a muzzle end of a firearm, the tubular housing defining a hollow interior surrounding a path along which a projectile can travel;

the tubular housing having a first end and a second end, the first end secured to the muzzle end of the firearm, and the second end oppositely disposed, the tubular housing comprising:

a plurality of dynamic volume chambers disposed between the first end and the second end, each set of dynamic volume chambers comprising:

axially variable material sequentially arranged and having an initial state of equilibrium wherein each of the materials are in an initial compressed state, including a first of the materials in a first dynamic volume chamber and a second of the materials in a second dynamic volume chamber; and a separator in communication with the materials, the separator and the at least two materials having aligned apertures through which the projectile travels; and the at least two materials subject to expansion and contraction in an axial direction when subject to a load received from the projectile.

13. The apparatus of claim 12, wherein the material is selected from the group consisting of: a spring, an elastomer, polyurethane, neoprene, silicone rubber, and a fluid responsive material.

14. The apparatus of claim 12, wherein the material absorbs compression and rarefaction of ambient gas.

15. The apparatus of claim 12, further comprising the materials to change axially when subject to a load received from the projectile.

16. The apparatus of claim 15, wherein axial change of the materials includes consumption of an element selected from the group consisting of: gas emitted from the projectile, percussive energy from the projectile, and combinations thereof, the element being a byproduct from the projectile as it travels through the chamber.

17. The apparatus of claim 15, further comprising the first chamber having a proximal end adjacent to the muzzle end a distal end adjacent to a proximal end of the second chamber.

18. The apparatus of claim 17, wherein the axial change further comprising the first of the materials to receive a load from the projectile to be subject to a first decompression, while the second of the materials to remain in a compressed state.

19. The apparatus of claim 18, further comprising the second of the materials to receive the load from the projectile after an exit from the first chamber and the second material to decompress while the first material returns to a compressed state.

20. The apparatus of claim 19, further comprising the materials to return to the state of equilibrium following exit of the projectile from tubular housing.

21. The apparatus of claim 12, further comprising the separator to move in an axial direction with axial movement of the materials associated with the load received from the projectile.

22. The apparatus of claim 21, further comprising the axial movement of the separator to remove debris from an interior wall surface of the tubular housing.

23. The apparatus of claim 21, further comprising the axial movement of the separator to absorb sound energy transmitted from gases emitted with travel of the projectile.

* * * * *